US006056625A

United States Patent [19]

Fildan

[11] Patent Number: 6,056,625

[45] Date of Patent: May 2, 2000

[54] BRASSIERE-STRAP SLIDE

[76] Inventor: Gerhard Fildan, Dr. Körner Str. 64, A-2521 Trumau, Austria

[21] Appl. No.: 09/304,876

[22] Filed: May 4, 1999

[51] Int. Cl.[7] ..... A41C 3/00; A44B 11/02

[52] U.S. Cl. ..... 450/86; 450/1; 2/336; 24/200; 24/197; 24/198

[58] Field of Search ..... 450/86, 1, 18, 450/25, 63, 64, 88, 93; 24/197, 198, 200; 2/67, 336, 338, 312–314, 315, 320, 321, 335, 326, 268, 271, 323

[56] References Cited

U.S. PATENT DOCUMENTS

| | | | |
|---|---|---|---|
| 2,133,153 | 10/1938 | Saulson | 24/198 |
| 2,224,773 | 12/1940 | Shaulson | 24/198 |
| 2,260,060 | 10/1941 | Shaulson | 24/198 |
| 3,075,268 | 1/1963 | Schwartz | 24/200 |
| 3,077,650 | 2/1963 | Horne | 24/200 |
| 3,161,931 | 12/1964 | Zif | 24/200 |
| 3,164,154 | 1/1965 | Simonsen | 24/200 X |
| 3,290,696 | 12/1966 | Rosenzweig | 2/323 |
| 5,590,443 | 1/1997 | Fildan | 24/200 |

*Primary Examiner*—Gloria M. Hale
*Attorney, Agent, or Firm*—Herbert Dubno

[57] ABSTRACT

A brassiere slider has its crossbar recessed below the planes of edges of the longitudinal limits which limits sliding of the frame on a strap. The recessed configuration of the crossbar makes the assembly flatter and also increases the security against slide movement of the slider on the strap.

20 Claims, 4 Drawing Sheets

FIG. 2
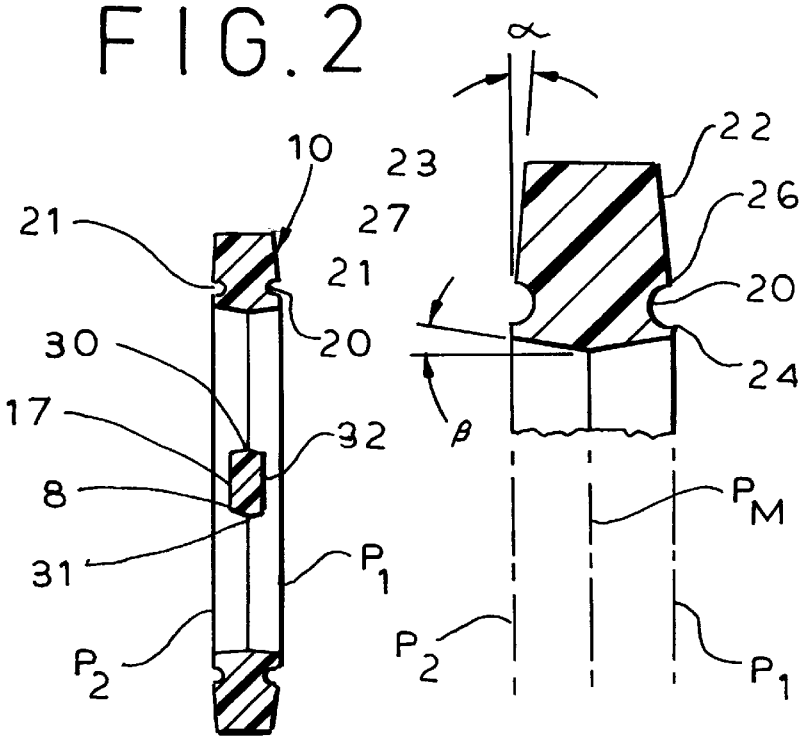
FIG. 5
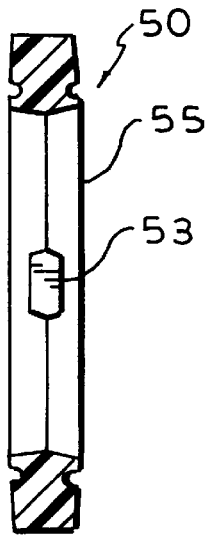
FIG. 3
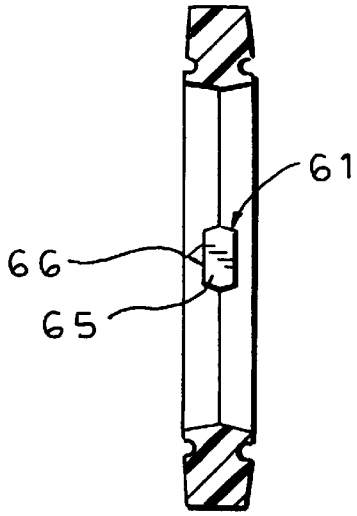
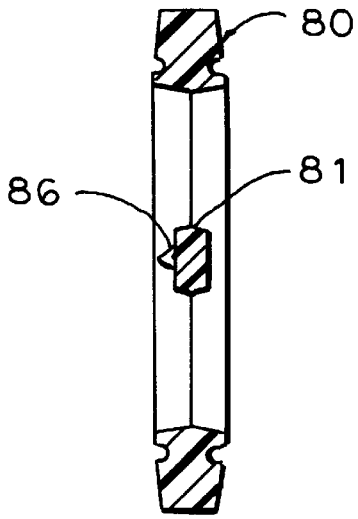
FIG. 7
FIG. 9

BRASSIERE-STRAP SLIDE

FIELD OF THE INVENTION

My present invention relates to a brassiere-strap slide and to a brassiere-strap assembly utilizing an improved brassiere-strap slide. It should be noted that, while the description is here directed to brassieres, the slide may be utilized on other articles of lingerie and even in swimsuit or other garment applications and the invention is thus deemed to apply to those as well.

BACKGROUND OF THE INVENTION

As described in my copending application Ser. No. 09/189,364 of Nov. 9, 1998, a typical brassiere-strap slide has two slots through which a brassiere strap can be guided behind a crossbar over which a loop of the strap may be permanently engaged. Adjustments of the strap are effected by releasing the tension on the strap and sliding the slider upwardly and downwardly thereon.

The aforementioned application explains that involuntary displacement of the slides is possible by the action of a wearer, for example, jogging, or because of the need for the strap or the garment to support significant weight. An involuntary movement requires readjustment of the slider and readjustment may be awkward, inconvenient or embarrassing if it must take place at inappropriate times. As a consequence, in the aforementioned application I have described a slider which because it utilizes two edges for engagement with the strap at each longitudinal limb of the slider frame, greatly limits involuntary shift and provides a more reliable and secure slider without interfering with the adjustability.

One of the problems of that slider, however, and sliders of the prior art previous to my above-mentioned improved slider, has been that the slider assembly is somewhat bulky and tends to stand out from the body to an excessive extent.

OBJECTS OF THE INVENTION

It is the principal object of the present invention to provide a slider which improves upon the unit described in the aforementioned copending application but is more compact and functionally more reliable than that slider or brassiere-strap assembly.

It is also an object of the invention to provide a highly compact and flat slider and brassiere-strap assembly whereby drawbacks of earlier systems are avoided.

Still another object of the invention is to provide an improved slide for linear and especially for brassiere straps which has improved capacity for retaining the originally set position and tension.

SUMMARY OF THE INVENTION

These objects and others which will become apparent hereinafter are attained, in accordance with the invention, in an adjustable slider of the type described in my earlier application wherein the crossbar is of reduced thickness so that it is set back from the planes of the laterally-projecting edges on the longitudinal frame limbs such that, even if the strap fabric lying against the crossbar is of double thickness, the entire assembly remains flat and strap bulges are not produced.

The crossbar can be continuous between the transverse limits or can be subdivided, preferably centrally, into two inwardly-projecting segments which provide a spacing between them. While the end of the shoulder strap can be looped around the crossbar to anchor the shoulder strap to the crossbar, I have found it to be especially advantageous to weld the end of the strap to a recessed face of the crossbar. Such welding is facilitated by providing that face with a multiplicity of projections.

More particularly, the brassiere-strap slide of the invention comprises a slide body in the form of a frame having a pair of mutually parallel longitudinal frame limbs, a pair of transverse frame limbs connecting the longitudinal frame limbs, and a crossbar between the transverse frame limbs and parallel to the longitudinal frame limbs, the body being formed with a respective oval slot between the crossbar and each of the longitudinal frame limbs whereby a brassiere strap is adapted to pass across a flank of one of the longitudinal frame limbs, through one of the slots, behind the crossbar, through the other of the slots and across a corresponding flank of the other of the longitudinal frame limbs, the flanks each being formed with a laterally projecting longitudinal edge adjoining the respective slot and a further longitudinal edge spaced inwardly along the respective flank from the laterally projecting longitudinal edge, so that the strap while tensioned is retained against slip by the edges on both the flanks, the laterally projecting longitudinal edges defining a plane, the crossbar having at least one face parallel to and set back inwardly from the plane.

Advantageously, a loop of the strap is secured around the crossbar and the crossbar has faces on opposite sides thereof, each of which is set back from a respective plane of the laterally-projecting edges of the longitudinal frame limbs.

As is clear from the foregoing, the improved slide of the invention retains the double edge configuration of the above-mentioned copending application whereby on each flank of a longitudinal frame limb, the laterally-projecting edge delimiting the oval slot is spaced from another edge by an outwardly open groove. The outwardly open groove of each longitudinal frame limb can extend continuously around the slots.

The flanks of each of the longitudinal frame limbs can converge toward the outer perimeter of the frame and can form angles of 10 to 20° with the respective planes. The preferred angle is about 16°.

Inner peripheries of each longitudinal frame limb can be beveled outwardly from a longitudinal median plane of the frame and the bevels can be at angles ranging from 3 to 10° with planes perpendicular to that longitudinal median plane.

The invention also resides in a brassiere-strap assembly utilizing such a slide and this assembly can comprise:

a brassiere-strap slide having a slide body in the form of a frame provided with a pair of mutually parallel longitudinal frame limbs, a pair of transverse frame limbs connecting the longitudinal frame limbs, and a crossbar between the transverse frame limbs and parallel to the longitudinal frame limbs, the body being formed with a respective oval slot between the crossbar and each of the longitudinal frame limbs, the longitudinal frame limbs having flanks on opposite sides thereof, each of the flanks being formed with a laterally-projecting longitudinal edge adjoining the respective slot and defining a respective plane along the respective side of the frame, and a further longitudinal edge spaced inwardly along the respective flank from the laterally-projecting longitudinal edge, the crossbar having opposite faces each set inwardly and spaced from the respective one of the planes;

a brassiere strap having an end secured onto the crossbar and a stretch passing across one of the flanks of one of the longitudinal frame limbs, through one of the slots, behind the crossbar, through the other of the slots and across a corresponding flank of the other of the longitudinal frame limbs so that the strap while tensioned is retained against the slit by the edges on both of the flanks across which the stretch passes; and a ring connectable to a brassiere cup and traversed by the stretch.

The center bar can, if desired, be asymmetrical with respect to the planes of the laterally projecting longitudinal edges, i.e. can have one surface set back from one of the planes and the other surface lying in the other of these planes.

BRIEF DESCRIPTION OF THE DRAWING

The above and other objects, features, and advantages will become more readily apparent from the following description, reference being made to the accompanying drawing in which:

FIG. 2 is a cross sectional view taken along the line II—II of FIG. 1;

FIG. 3 is a detail of the cross section of the longitudinal frame limb and is applicable to the embodiments of the subsequent Figures as well;

FIG. 5 is a section along the line V—V of FIG. 4;

FIG. 7 is a cross section along the line VII—VII of FIG. 6;

FIG. 9 is a cross section along the line IX—IX of FIG. 8;

SPECIFIC DESCRIPTION

Figure 1:
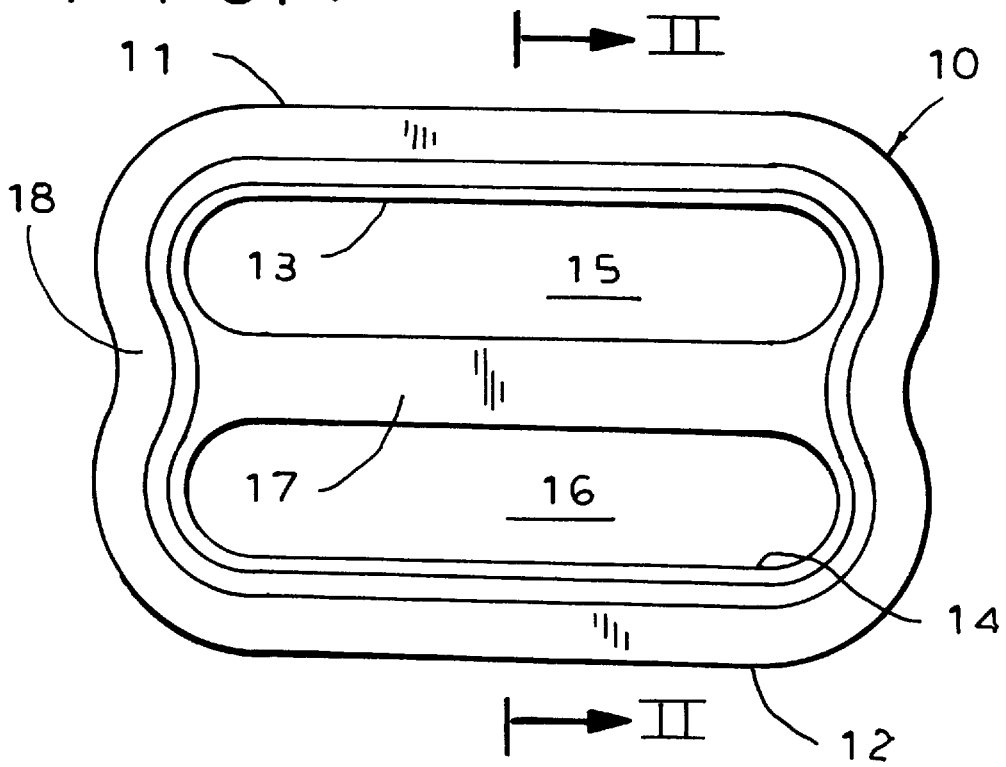
FIG. 1 is a front elevational view of a slider according to the present invention, the rear view being identical thereto.

The adjustable strap slide shown in FIGS. 1 and 2 comprises a pair of longitudinal frame limbs 11, 12, each of which has an inner periphery 13, 14 delimiting an oval slot or window 15, 16 with a crossbar 17. As can be seen from FIG. 1, the longitudinal frame limbs 11 and 12 are interconnected by transverse frame limbs 18, 19 and extending all around the frame limbs are grooves 20 and 21 on the respective side of the frame (see FIG. 2).

As can best be seen from the detail view of FIG. 3, the grooves 20 and 21 of the converging flanks 22, 23 of the longitudinal frame limbs, separate a laterally-projecting edge 24 or 25 from another edge 26 or 27 so that, when a strap lies along the flank 22 or 23, it can be engaged by both of the edges 24, 26 or 25, 27. The laterally projecting edges 24, 25 on the respective side of the frame define planes $P_1$ and $P_2$ which are parallel to the longitudinal median plane $P_M$. The edges 26 and 27 may lie in the planes $P_1$, $P_2$, can be set slightly back from the planes $P_1$, $P_2$ or may project outwardly slightly behind the planes $P_1$, $P_2$ as may be desired.

According to the invention, the crossbar 17 which may have a hexagonal cross section (see FIG. 2) and thus may have bevels at 30 and 31 along the edges delimiting the slots 15 and 16, have faces 32 and 33 which are set inwardly from the planes $P_1$, $P_2$ by, for example, 0.5 mm.

The tapers of the flanks 22 and 23 are represented by the angles $\alpha$ which may range between 10 and 20° and preferably is around 16°. The inner edges 13 and 14 are beveled so that they form angles $\beta$ with planes perpendicular to the median plane $P_M$, where $\beta$ may range between 3 and 10° and preferably is about 8°.

Figures 10, 11, 12:
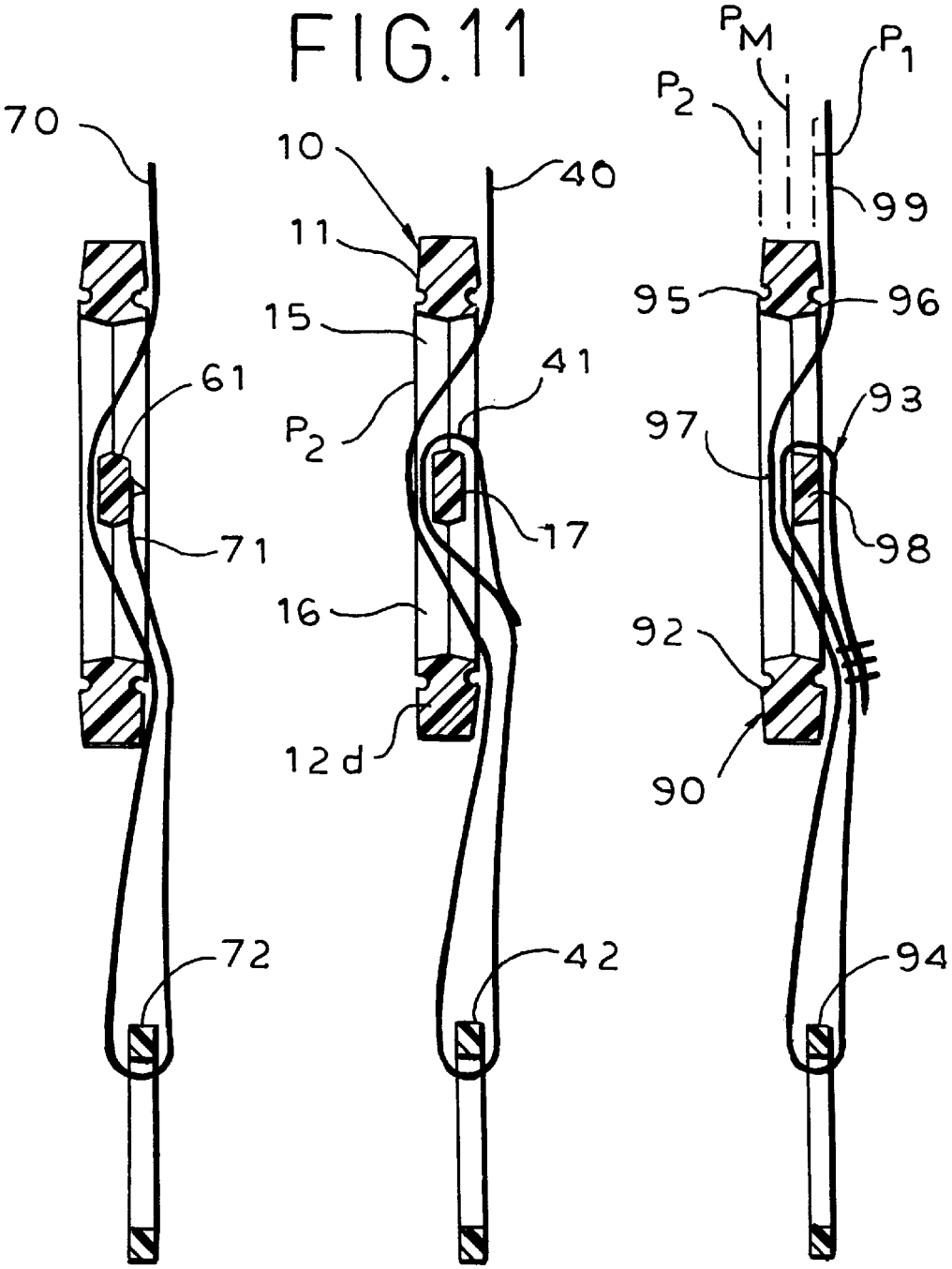
FIG. 10 is a diagrammatic section showing the strap threading pattern for the assembly.
FIG. 11 is a view similar to FIG. 10 of another strap threading pattern.
FIG. 12 is another strap threading pattern using a nonslip slide with an asymmetric center bar.

As can be seen from FIG. 11, a slider 10 is used in the assembly of the invention. A shoulder strap 40 of a brassiere may have a loop 41 which encircles the crossbar 17 and then extends through a ring 42 which can be of the type described in the aforementioned application before passing through the slot 16 around the crossbar 17 and back through the slot 15. The strap 40 lies against the right-hand flanks of the upper and lower limbs 11 and 12 when the strap is tensioned. The two edges of each of those flanks engage the strap and prevent slip of the slider 10 thereon. When the tension is relaxed, the slider can be moved for adjustment purposes. When the slider is tensioned even though two layers of strap are found at the crossbar 17, they will not project beyond the plane $P_2$ and hence the assembly has a significantly flatter appearance then the assemblies described in the aforementioned application and those which represent prior art thereto.

Figure 4:
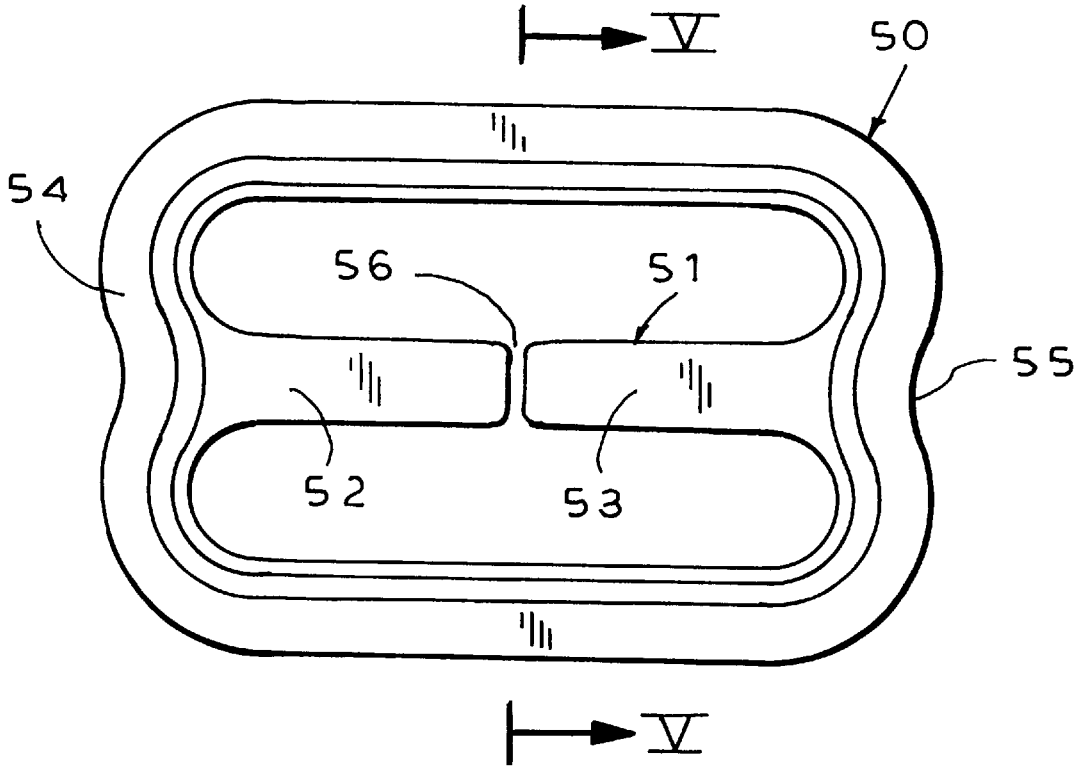
FIG. 4 is a view similar to FIG. 1 showing an embodiment in which the crossbar is subdivided.

In FIG. 4 it will be apparent that the frame 50 of the slide is generally similar to the frame of the slide previously described except that the crossbar 51 is subdivided into two segments 52 and 53 each of which projects inwardly from a respective one of the transverse limbs 54 and 55. If desired, thread loop 41 can be preformed and slipped over the segments 52 and 53 through the gap 56 between them. Otherwise the slider is constructed and operates in the manner previously described.

Figure 6:
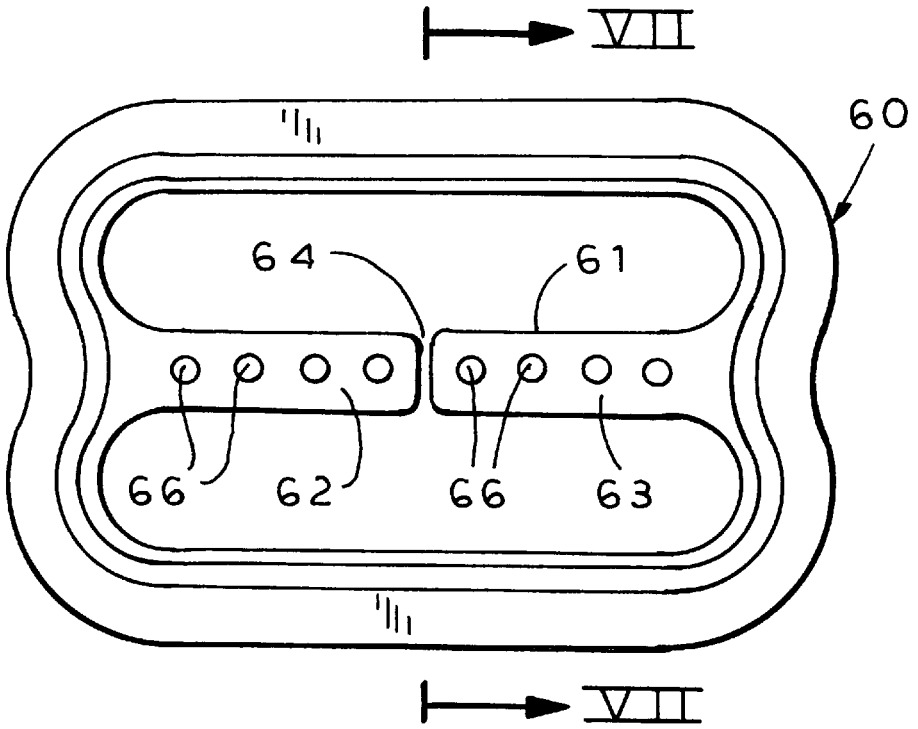
FIG. 6 is a view similar to FIG. 4 of an embodiment having a split crossbar but wherein the crossbar is additionally provided with projections to facilitate the welding of the brassier strap to the slider.

In the embodiment of FIGS. 6 and 7, the slider 60 is formed with a crossbar 61 which is subdivided into segments 62 and 63 by a gap 64 and the face 65 of the crossbar 61 to which a strap is to be secured by ultrasonic or thermal welding is formed with a multiplicity of conical projections 66 which, upon such welding, merges with the material of the strap.

In FIG. 10, the end 71 of a strap 70 is shown to be thermally welded to the crossbar 61 of the slider 60. From the welded end, the strap extends through the ring 72 then back through the slots of the slider around the other side of the crossbar 61. The assembly of FIG. 10 operates in the same manner as that of FIG. 11.

Figure 8:
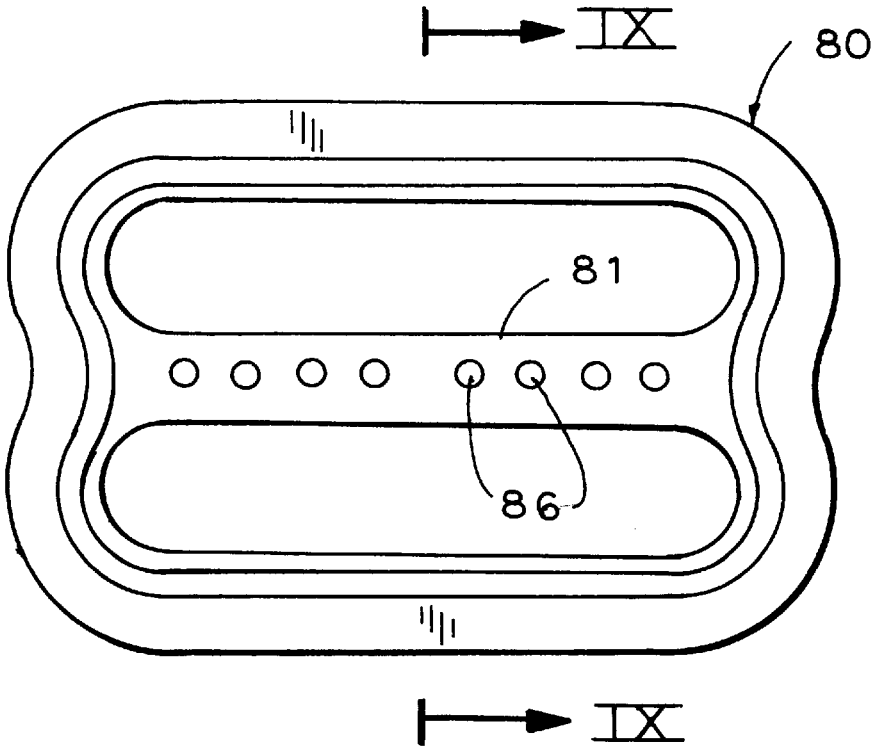
FIG. 8 is a view similar to FIG. 1 showing a modification of that embodiment with such projections.

Finally, with the slider 80 of FIG. 8, a continuous crossbar 81 is provided and is formed on one face with the projections 86 which can be fused to the strap as has been described. The sliders in each case and the rings are injection molded and the distance d by which the crossbar is recessed is preferably 0.5 mm on each side below the plane, $P_1$, $P_2$ on the respective side. However, d can range between 0.1 and 0.7 mm if desired.

The thickness of the crossbar can thus be 1 mm in the case of a slider whose limits have a maximum thickness of say 2 mm. The slider can be composed of polyoxymethylene.

In FIG. 12, the slider 90 has its longitudinal limbs 91 and 92 formed with laterally projecting edges 95 and 96 lying in planes $P_1$ and $P_2$ as previously described. The central bar 93, however, is here asymmetric with respect to the planes $P_1$ and $P_2$ and has one side 97 lying in the median plane Pm and thus set inwardly from the plane $P_2$ while the other surface 98 lies in the plane $P_1$. The more recessed side corresponds to the side at which the strap fabrication is doubled in threading of the strap 99 through the slide and around the ring 94.

I claim:

1. A brassiere-strap slide comprising a slide body in the form of a frame having a pair of mutually parallel longitudinal frame limbs, a pair of transverse frame limbs connecting said longitudinal frame limbs, and a crossbar between said transverse frame limbs and parallel to said longitudinal frame limbs, said body being formed with a respective oval slot between said crossbar and each of said longitudinal frame limbs whereby a brassiere strap is adapted to pass across a flank of one of said longitudinal frame limbs, through one of said slots, behind said crossbar, through the other of said slots and across a corresponding flank of the other of said longitudinal frame limbs, said flanks each being formed with a laterally projecting longitudinal edge adjoining the respective slot and a further longitudinal edge spaced inwardly along the respective flank from the laterally projecting longitudinal edge, so that said strap while tensioned is retained against slip by the edges on both said flanks, said laterally projecting longitudinal edges defining a plane, said crossbar having at least one face parallel to and set back inwardly from said plane.

2. The brassiere-strap slide defined in claim 1 wherein a loop of said strap is secured around said crossbar and said crossbar has faces on opposite sides thereof each set back from a respective plane of laterally projecting edges of said longitudinal frame limbs on opposite sides of said frame.

3. The brassiere-strap slide defined in claim 1 wherein said further edge is separated from said laterally projecting edge for each of said flanks by a continuous outwardly open groove formed in said limbs of said frame around said slots.

4. The brassiere-strap slide defined in claim 3 wherein said body is formed with corresponding flanks, edges and grooves symmetrically along opposite faces of said body.

5. The brassiere-strap slide defined in claim 4 wherein said flanks of each of said longitudinal frame limbs converge toward the outer perimeter of the frame.

6. The brassiere-strap slide defined in claim 5 wherein each of said flanks forms an angle of about 10 to 20° with said planes of the slide.

7. The brassiere-strap slide defined in claim 6 wherein each of said longitudinal frame limbs has an inner peripheral side delimiting the respective slot and beveled outwardly to the respective laterally projecting edge.

8. The brassiere-strap slide defined in claim 1 wherein said crossbar is subdivided into two segments projecting inwardly from the respective transverse limbs.

9. The brassiere-strap slide defined in claim 1, further comprising a multiplicity of projections on said face of said crossbar for welding to a strap end.

10. The brassiere-strap slide defined in claim 9 wherein said crossbar is subdivided into two segments projecting inwardly from the respective transverse limbs.

11. The brassiere slide defined in claim 4 wherein said cross bar is disposed asymmetrically with respect to the planes of said longitudinal edges.

12. A brassiere-strap assembly comprising:

a brassiere-strap slide having a slide body in the form of a frame provided with a pair of mutually parallel longitudinal frame limbs, a pair of transverse frame limbs connecting said longitudinal frame limbs, and a crossbar between said transverse frame limbs and parallel to said longitudinal frame limbs, said body being formed with a respective oval slot between said crossbar and each of said longitudinal frame limbs, said longitudinal frame limbs having flanks on opposite sides thereof, each of said flanks being formed with a laterally-projecting longitudinal edge adjoining the respective slot and defining a respective plane along the respective side of the frame, and a further longitudinal edge spaced inwardly along the respective flank from the laterally-projecting longitudinal edge, said crossbar having opposite faces, at least one of said faces being set inwardly of and spaced from the respective one of said planes;

a brassiere strap having an end secured onto the said crossbar and a stretch passing across one of said flanks of one of said longitudinal frame limbs, through one of said slots, behind said crossbar, through the other of said slots and across a corresponding flank of the other of said longitudinal frame limbs so that said strap while tensioned is retained against the slit by the edges on both of the flanks across which said stretch passes; and a ring connectable to a brassiere cup and traversed by said stretch.

13. The brassiere-strap assembly defined in claim 12 wherein each of said further edges is separated from the respective laterally-projecting edge by a continuous outwardly open groove formed in said limbs of said frame around said slots.

14. The brassiere-strap assembly defined in claim 12 wherein said end of said strap is formed with a loop surrounding said crossbar.

15. The brassiere-strap assembly defined in claim 12 wherein said end of said strap is welded to one of said faces of said crossbar.

16. The brassiere-strap assembly defined in claim 15 wherein said one of said faces is formed with a plurality of projections, said end of said strap being welded to said crossbar at said projections.

17. The brassiere-strap assembly defined in claim 16 wherein said crossbar is subdivided into two segments projecting inwardly from the respective transverse limbs.

18. The brassiere-strap assembly defined in claim 12 wherein said crossbar is subdivided into two segments projecting inwardly from the respective transverse limbs.

19. The brassiere-strap assembly defined in claim 11 wherein said flanks of each of said longitudinal frame limbs converge toward an outer perimeter of the frame, wherein each of said flanks forming an angle of about 10 to 20° with said plane, wherein each of said longitudinal frame limbs having an inner peripheral side delimiting the respective slot and beveled outwardly to the respective laterally-projecting edge.

20. The brassiere-strap assembly defined in claim 19 wherein said crossbar is disposed asymettrically with respect to said planes.

* * * * *